US006227118B1

(12) United States Patent
Nance

(10) Patent No.: US 6,227,118 B1
(45) Date of Patent: May 8, 2001

(54) VAPORIZER AND AEROSOL GENERATOR

(75) Inventor: Gettis A. Nance, Dahlgren, VA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 04/745,658

(22) Filed: Jul. 15, 1968

(51) Int. Cl.[7] ..... F42B 12/46

(52) U.S. Cl. ..... 102/367; 102/334; 102/369; 149/83

(58) Field of Search ..... 260/944; 102/6, 102/90, 66, 334, 364, 367, 368, 369, 370; 199/83; 149/83

(56) References Cited

U.S. PATENT DOCUMENTS 2,115,608 * 4/1938 Brandt ..... 102/66
2,354,882 * 8/1944 Samann ..... 102/6
2,578,726 * 12/1951 Moore ..... 102/6
3,335,039 * 8/1967 Niles et al. ..... 149/83
3,335,040 * 8/1967 Niles ..... 149/83
3,380,383 * 4/1968 Schnepfe, Jr. ..... 102/64

FOREIGN PATENT DOCUMENTS

443451 * 2/1936 (GB) ..... 102/6

* cited by examiner

*Primary Examiner*—Harold J. Tudor
(74) *Attorney, Agent, or Firm*—James B. Bechtel, Esq.

(57) ABSTRACT

This invention is directed to a device for generating a V agent vapor and aerosol. The device comprises a container having a first and second chamber separated by a destructable diaphragm. The chemical components necessary to form the V agent are divided between the two compartments. Freon or a similar fluorinated hydrocarbon is placed in one of the chambers which communicates with an ejection nozzle through a sealed opening. An explosive charge is detonated to remove the diaphragm between the compartments and to allow the chemical components to combine and form the V agent. The heat of the reaction in the presence of the freon causes the pressure to increase in the chamber. This pressure, together with the heat of reaction, breaks the seal between the chambers and the ejection nozzle and the V agent is ejected from the nozzle as a vapor and aerosol.

5 Claims, 1 Drawing Sheet

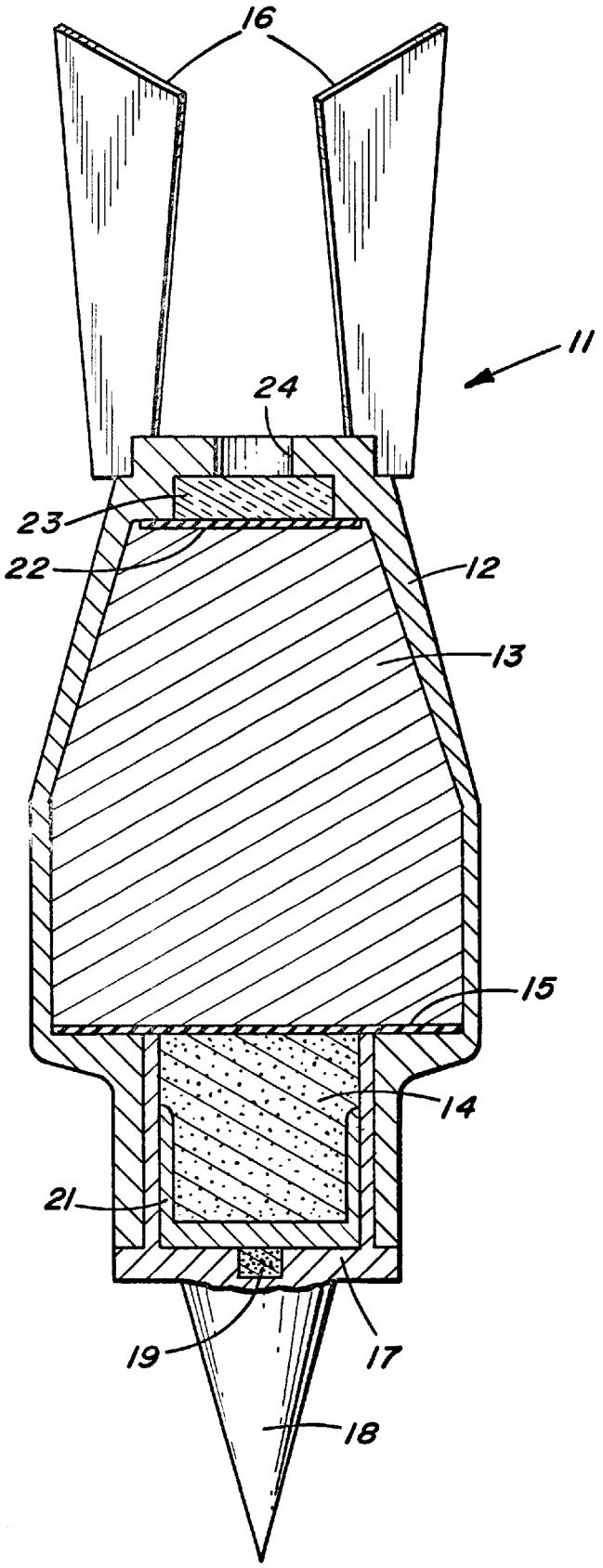
16
11
24
23
22
12
13
15
14
21
19
17
18

VAPORIZER AND AEROSOL GENERATOR

STATEMENT OF GOVERNMENT INTEREST

The invention defined herein may be manufactured and used by or for the Government of the United States of America for Governmental purposes without the payment of any royalties thereon or therefor.

BACKGROUND OF THE INVENTION

1. Field of the Invention

V agents are a class of anticholinesterase warfare gases. They are in liquid form under all climatic conditions and are toxic in either the liquid, vapor or aerosol form. The present invention is directed to a V agent vaporizer and aerosol generating device.

2. Description of the Prior Art

The most common prior art technique for generating a V agent vapor and aerosol is the use of explosive bursters with a liquid V agent. This method has proved to be inefficient. Tests have shown that only 10% of the V agent present is disseminated by this method. Furthermore, the method is also unreliable because in a relatively high percentage of applications, the V agent ignites and combusts with no significant dissemination of the V agent.

High pressure nozzles have also been used in the prior art to produce a V agent aerosol. This method is disadvantageous because high pressures in the range of 3000 to 4000 psi are required to break up the agent into an aerosol. This high pressure requires the use of heavy, high strength vessels to contain the V agent and results in a low V agent to total weight ratio. In addition, this method requires the use of fine nozzles which are subject to clogging and are difficult and expensive to manufacture.

A further disadvantage of both of the above methods is the requirement that personnel using these methods must handle the highly toxic V agent at some stage in the logistic cycle.

SUMMARY OF THE INVENTION

The present invention is a significant advance over the prior art. The inventive device is highly efficient and allows the dissemination of virtually all the V agent. The inventive device is very reliable because the explosive used is separated from the reaction area and there is no possibility of the V agent combusting.

The subject invention disseminates the V agent as a vapor and aerosol at a low pressure through a large nozzle. The inventive device has a low weight and is not subject to restrictive production tolerances.

In addition the V agent is not produced by the present invention until the time of dissemination. Use of the inventive device is, therefore, extremely safer than prior art devices because the V agent is never handled in the logistic cycle.

The inventive device comprises a container having two compartments separated by a destructable partition. One end of the container is formed into a nozzle which is separated from the first compartment by a seal. A cup-shaped member is slidably mounted in the second compartment and an explosive is placed behind it. The chemical components of the V agent are divided between the two compartments and freon is placed in one of them. They are combined when the explosive is detonated and forces the cup member against the destructable partition. The chemicals combine to form the V agent and the heat of reaction destroys the nozzle seal.

The pressure developed by the reaction of the chemicals forces the V agent and the freon out of the nozzle and the mixture upon contact with the atmosphere vaporizes and forms an aerosol.

It is an object of this invention to provide a new and improved vaporizer and aerosol generator.

It is another object of this invention to provide an efficient and reliable V agent vaporizer and aerosol generator.

It is yet another object of this invention to provide a V agent vaporizer and aerosol generator which operates at a low pressure.

It is a further object of this invention to provide a V agent vaporizer and aerosol generator which is light in weight, simple to construct and safe to handle.

It is a still further object of this invention to provide a V agent vaporizer and aerosol generator in which the components of the V agent are initially stored in separate compartments.

Other objects and advantages of the invention will become apparent from the following drawings and specification in which:

BRIEF DESCRIPTION OF THE DRAWINGS

The FIGURE shows a cross-sectional view of the V agent vaporizer aerosol generator.

DESCRIPTION OF THE PREFERRED EMBODIMENTS

Referring to the drawing, the vaporizer and aerosol generator 11 is shown in the shape of a bomb which can be dropped from an aircraft. It should be understood that this is shown only by way of example and that the shape of the generator may be modified to suit the purpose for which it is to be used.

The generator 11 is comprised of a circular container 12 having a first 13 and second 14 compartment separated by a destructable diaphragm 15. The container has fins 16 and a cap 17 to which cone 18 is attached. An explosive 19 is mounted in cap 17 and is operative when ignited to propel cup-shaped member 21 to the rear of the generator. The first chamber 14 is shown filled with sulfur. The second chamber 13 is filled with the remaining components of the V agent except that freon or a similar fluorinated hydrocarbon is placed in one of the two chambers irrespective of whether that one chamber contains the sulfur or the remaining components of the V agent.

A destructable diaphragm 22 and a thermal delay device 23 initially block the dissemination port 24 at the rear of container 12. The port has a diameter of at least ½ inch.

In operation explosive 19 is ignited and rapidly propels cup-shaped member 21 to the rear of the generator. This breaks the diaphragm and forces the sulfur in compartment 14 into the second compartment 13 where it combines with O-ethyl O'-diisopropylaminoethyl methlphosphonite contained therein, for example, to form the V agent VX. The molar heat of this reaction if 26.8 K calories/mole and raises the temperature of the VX 200° C. above the initial temperature of the reacting components.

The freon is in mixture with the VX at this point and serves to lower the boiling point of the mixture so that the VX is near its boiling point at the final reaction temperature. As a result of this, the vapor pressure, which is dependent on the freon—VX mixture, is increased to the range of 100 to 400 psi. The combination of these two factors destroys diaphragm 22 and thermal delay device 23 forcing the freon—VX mixture through dissemination port 24.

When the mixture reaches the atmosphere flashing or rapid vaporization of a large portion of the mixture occurs. The surface tension of the liquid mixture is significantly reduced by the freon and the liquid which does not vaporize is broken up into a fine aerosol.

The agent VX was chosen by way of example. The inventive device may be used with all the remaining V agent—VA, VE, VM, VS and VG. Each of these agents contains sulfur which is always placed in one of the two compartments in the generator.

Thus it is seen that a new and improved V agent vaporizer and aerosol generator, which is efficient, reliable, light in weight and safe to handle, has been provided.

Obviously many modifications and variations of the present invention are possible in the light of the above teachings. It is therefore to be understood that within the scope of the appended claims the invention may be practiced otherwise than as specifically described.

What is claimed is:

1. Vaporizing and aerosol generating apparatus comprising:

container having a small opening at one end;

a first destructable diaphragm mounted inside said container to divide it into two sealed compartments;

a second destructable diaphragm mounted inside said container and covering the opening therein;

a cup-shaped member having a bottom and sidewalls mounted in the first compartment formed by said first destructable diaphragm wherein said sidewalls are closer to said first destructable diaphragm than said bottom; and means mounted adjacent to said cup-shaped member for propelling the cup-shaped member toward said first destructable diaphragm to destroy said first dstructable diaphragm.

2. Vaporizing and aerosol generating apparatus as in claim 1 wherein said container has a cylindrical shape.

3. Vaporizing and aerosol generating apparatus as in claim 2 further comprising thermal delay means mounted between the opening in said container and said second destructable diaphragm and wherein the opening in said container communicates with the second compartment formed by said first destructable diaphragm.

4. Vaporizing and aerosol generating apparatus as in claim 1 wherein one of the two compartments formed in said container by said first destructable diaphragm contains sulfur; and the other of the two compartments formed in said container by said first destructable diaphragm contains a fluorinated hydrocarbon and O-ethyl O'-diisopropylaminoethyl methylphosphonite.

5. Vaporizing and aerosol generating apparatus as in claim 1 wherein one of the two compartments formed in said container by said first destructable diaphragm contains a fluorinated hydrocarbon and sulfur; and the other of the two compartments formed in said container by said first destructable diaphragm contains O-ethyl O'-diisopropylaminoethyl methylphosphonite.

* * * * *